United States Patent [19]

Waters

[11] 4,223,739

[45] Sep. 23, 1980

[54] PICTURE FRAME WITH FIRE EXTINGUISHING MEANS ASSOCIATED THEREWITH

[76] Inventor: Donald R. Waters, 641 Mariclaire Ave., Vandalia, Ohio 45377

[21] Appl. No.: 19,171

[22] Filed: Mar. 9, 1979

[51] Int. Cl.[3] ..... A62C 25/00

[52] U.S. Cl. ..... 169/52; 220/88 R

[58] Field of Search ..... 169/48, 51, 52, 30, 169/71, 80; 220/18, 88 R

[56] References Cited

U.S. PATENT DOCUMENTS

| | | | |
|---|---|---|---|
| 4,018,242 | 4/1977 | Schlegel | 169/51 |
| 4,034,699 | 7/1977 | Russell | 169/51 |

FOREIGN PATENT DOCUMENTS

| | | | |
|---|---|---|---|
| 364181 | 3/1960 | Switzerland | 169/51 |

*Primary Examiner*—Robert J. Spar
*Assistant Examiner*—Kenneth Noland
*Attorney, Agent, or Firm*—W. Britton Moore

[57] ABSTRACT

Picture frame having a fire resistant backing and being hollow to provide a storage compartment for fire extinguishing medium with a valve controlled nozzle projectable rearwardly thereof whereby in the event of fire the user may face the flames with the frame held in front as a protective shield and actuate the valve to direct extinguishing medium thereat.

8 Claims, 7 Drawing Figures

PICTURE FRAME WITH FIRE EXTINGUISHING MEANS ASSOCIATED THEREWITH

BACKGROUND OF THE INVENTION

This invention relates to a decorative picture frame having a fire resistant backing and a hollow storage compartment for accommodating fire extinguishing medium with a valve controlled nozzle projectable rearwardly thereof so that the frame may be removed from its wall position by the user and held in front as a shield and the valve actuated to discharge extinguishing medium at a fire.

While it is old in the fire extinguishing art to house the extinguishers in various enclosures, such as, those represented in U.S. Pat. Nos. to Keeler 531,591, Bronander 1,919,316, Aprea 2,805,724, Savage 3,942,669, Hattenhauser 3,067,822, and Fudge 4,015,250, none thereof provide a readily handled enclosure for a fire extinghishing medium which is adapted to be removed from its normal location and held by the user in front as a protective shield while discharging extinguishing medium therefrom and directed at a fire.

OBJECTS OF THE INVENTION

The principal object of the present invention is to provide a picture frame for holding a decorative painting or picture and having a fire resistant backing and a hollow storage compartment therein for fire extinguishing medium with a valve controlled nozzle projectable rearwardly thereof enabling the user to hold the frame in front as a protective shield while the nozzle is aimed and the valve actuated to discharge extinguishing medium at the flames.

Another object is the provision of a picture frame recessed at its front for receiving and mounting a picture therein and formed with a flat fire resistant backing, and wherein the frame is hollow to accommodate fire extinguishing medium therein with a nozzle projectable rearwardly therefrom for use in the event of fire.

Still another object is to provide a hollow picture frame with a flat fire resistant and protective shield forming backing, wherein fire extinguishing medium is stored therein with the nozzle thereof projectable rearwardly thereof and being actuable by the user through a side access opening in the frame.

A further object is the provision of a hollow picture frame wherein pressurized fire extinguishing medium is storable and housed in a side compartment thereof with its nozzle being projectable rearwardly through a frame opening for aiming at a fire as the frame is held by and in front of the user as a protective shield.

Still another object is to provide a generally rectangular hollow picture frame in which fire extinguishing medium is stored with the frame being mounted on a wall or other surface and readily removable therefrom for use as a protective shield and for discharging extinguishing medium at a fire.

These and other objects and advantages will be apparent as the specification is considered with the accompanying drawings, wherein FIG. 1 is a perspective view of the frame being held by the user as a protective shield and extinguishing medium being directed therefrom at a fire;

Figure 7:
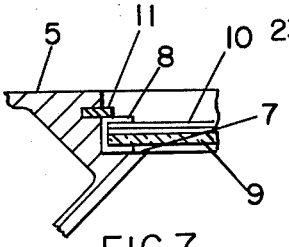
FIG. 7 is a section on the line 7—7 of FIG. 5.

Referring more particularly to the drawings, wherein similar reference characters designate like parts throughout the several views, numeral 1 generally identifies a hollow picture frame of any suitable metal. While the frame may assume various shapes and configurations, in the interest of clarity, it is illustrated and described herein as being generally rectangular, with flat top and bottom walls 2, flat end walls 3–4, and inwardly angularly extending front walls 5, mitered at their corners, as at 6, to form a rectangular picture receiving recess 7, in the usual manner, such as that shown in FIG. 7, wherein retaining tape 8 borders a picture or painting 9 which may be covered by a glass 10 secured therein by conventional retainers 11.

Figure 1:
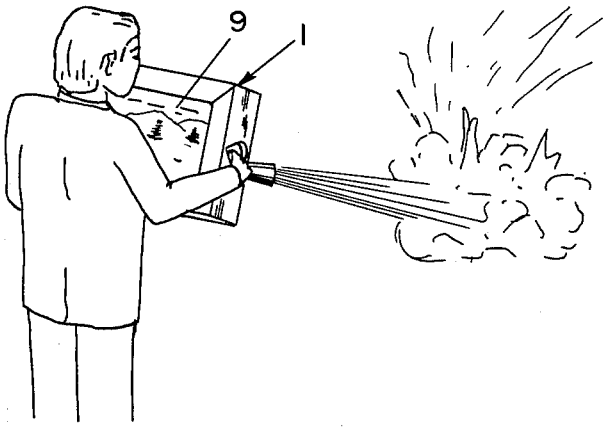
Figure 2:
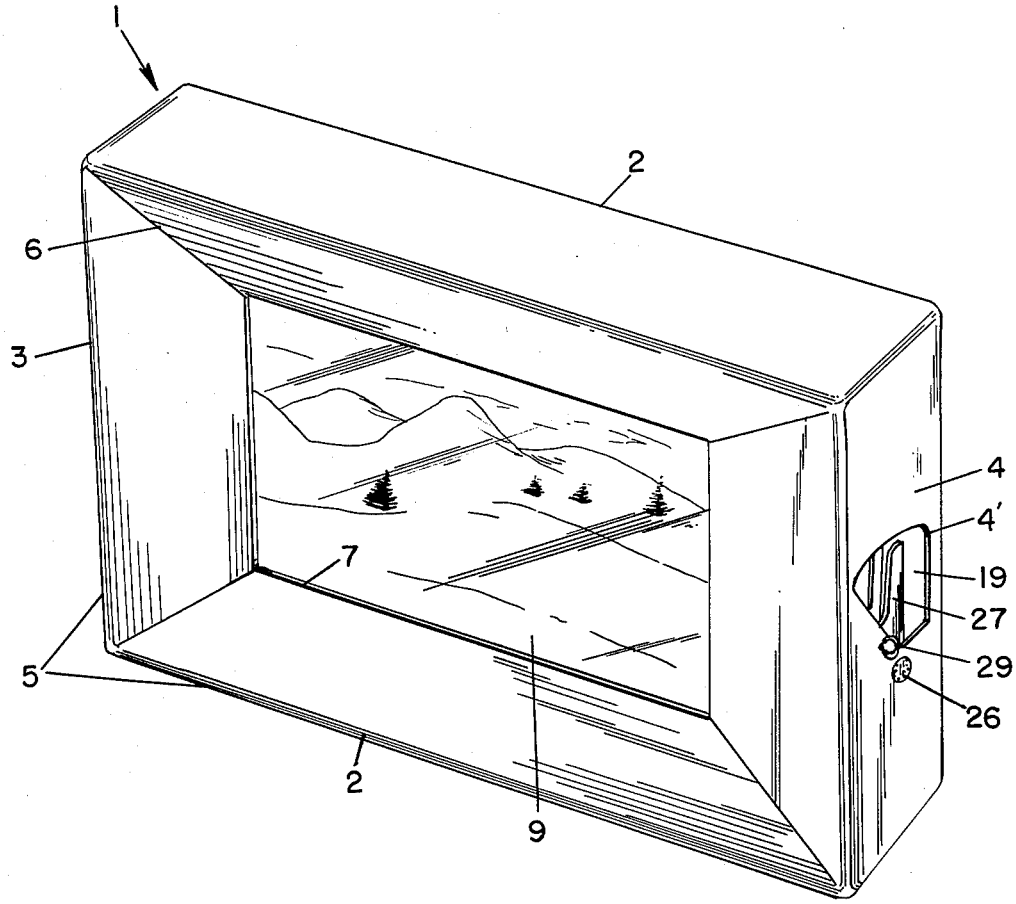
FIG. 2 is a front perspective view of the picture frame showing the extinguisher valve access opening in a side thereof.
Figure 3:
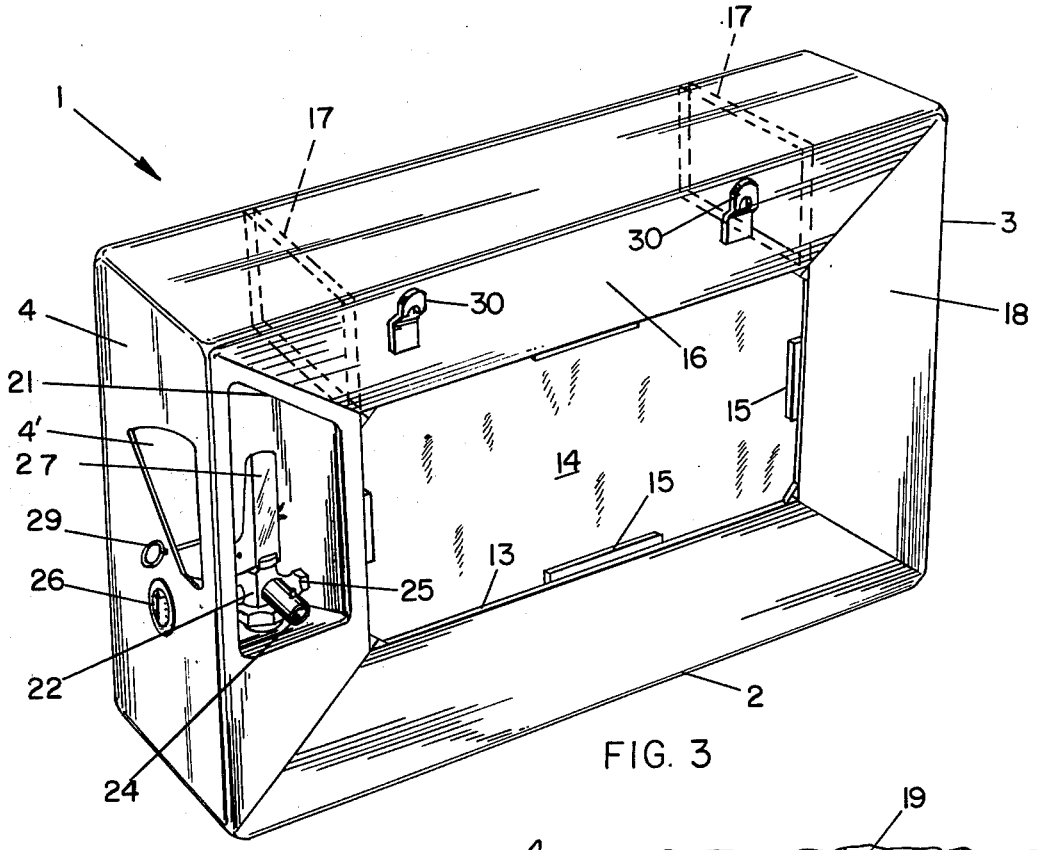
FIG. 3 is a rear perspective view of the frame, the fire resistant protecive backing, and an extinguisher valve and nozzle therefor arranged within a side compartment therein.
Figure 4:
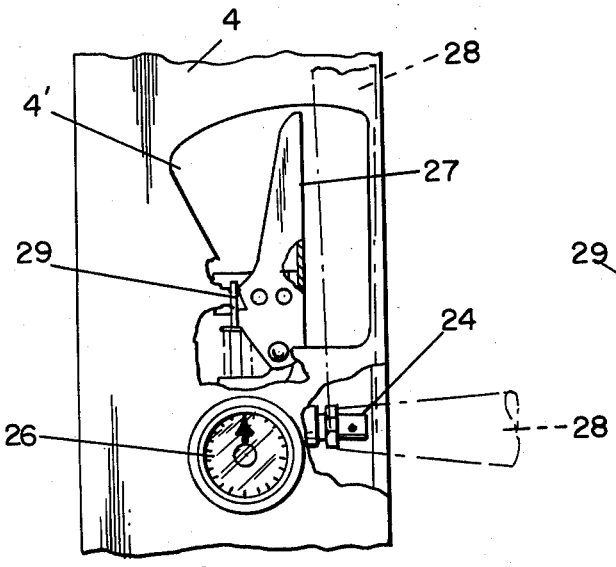
FIG. 4 is a side elevation of a portion of a side frame wall and the valve actuating access opening therein.
Figure 5:
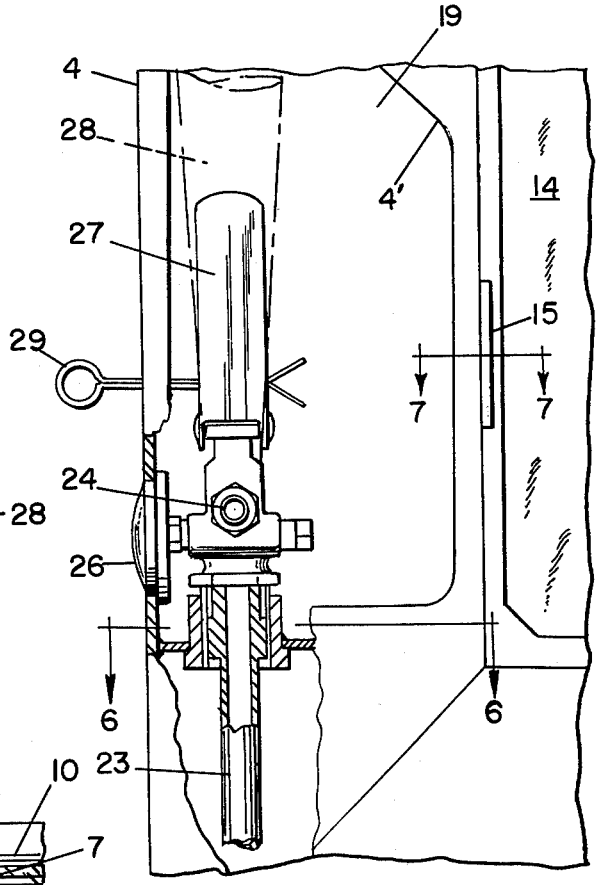
FIG. 5 is a rear view, partly in section, showing an extinguisher device and the nozzle therefor.
Figure 6:
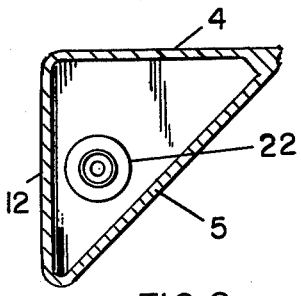
FIG. 6 is a section on the line 6—6 of FIG. 5.

Referring to FIG. 3, the frame is hollow and formed with a generally flat rear wall 12 with an enlarged rectangular opening 13 therein within which is suitably and flatly fixedly arranged a backing panel 14 of suitable fire resistant material and retained by suitable retaining strips 15. Arranged above the panel is a generally elongated hollow compartment 16 sealed at its ends by vertical walls 17, with sealed compartment 18 at the right hand end, viewing FIG. 3, extending throughout that end and across the lower end of the frame, below panel 14, and projecting upwardly at the left hand end thereof, where the compartment 18 is sealed by a horizontally extending flat wall 19. Disposed above wall 19 at this end of the frame is an open compartment 20 with an access opening 21 therein. This sealed compartment serves to store suitable fire extinguishing or retarding medium therein for discharge therefrom, as presently described.

In order to effect the discharge of fire extinguishing medium from frame compartment 18, a suitable standard and conventional valve assembly 25, with the usual indicating gauge 26 and pivoted actuating handle 27 may be suitably mounted in wall 19, and attached to the upper end of a tubular stand pipe 23 arranged therebelow, for controlling the discharge of extinguishing medium through an angularly adjustable nozzle 24, projectable outwardly through access opening 21, when the latter is aimed at the fire.

While the frame may be equipped with any suitable fire extinguishing medium, such as, fluid, foam, dry chemical, i.e., baking soda, or $CO_2$, should the latter be used, a suitable and conventional elongated tubular $CO_2$ horn 28 would be suitably clipped or otherwise attached to nozzle 24 so as to be swingable downwardly and protrude through the opening 21 when aimed at the fire. Such a horn 28 will only be required when $CO_2$ is used. However, it may be necessary to substitute or change nozzles 24, according to which type of the several extinguishing or retarding mediums is stored in compartment 18 to enable the same to be properly dispelled therefrom. Access for the user's hand to compartment 19 and valve handle 27 may be gained through an opening 4' in side frame wall 4 so that, as the frame is grasped in the user's hands with the rear and backing 14 facing the flames, the valve handle may be pivoted by the user's right hand to discharge extinguishing fluid thereat, in an obvious manner. The valve handle 27 may be locked in closed or in operative position by a locking pin 29, or the like, which, of course, must first be pulled or withdrawn therefrom before the handle and valve may be actuated.

As the standpipe 23 projects into compartment 18, when a particular extinguishing medium is to be introduced therethrough for storage therein, air will be compressed therein during fluid entry. The valve 25 may then be closed and a hose from a suitable source of compressed air, not shown, may be attached to the valve 25 and the latter opened to enable a predetermined amount of compressed air to be added to the compartment which increases the pressure under which the medium therein is being stored, whereat the valve 25 is again closed. Thus, when it is desired to use the device, the nozzle may be aimed at the fire to be extinguished and the valve opened so that a sufficient amount of medium under pressure is released from the compartment and dispelled in a stream thereat, or until all of the supply thereof is completely exhausted.

Suitable flat hanger clips 30 having bent upper ends 31 with notches 32 therein are suitably spacedly attached to the flat rear wall 12 to enable frame mounting on a wall surface, in an obvious manner. However, it will be apparent that the frame may otherwise be suitably wall hung, in other conventional ways.

While the frame has been shown and described as including top, bottom and end mitered walls, it will be understood that a unitary hollow frame may be provided, inasmuch as the important aspect is that the frame be formed with a protective fire resistant backing, and a hollow compartment for accommodating fire extinguishing medium. Therefore, it is to be further understood that various changes and various improvements may be made therein without departing from the scope and spirit of the appended claims.

What I claim is:

1. In a combination decorative picture frame and fire extinguishing device, a hollow frame including a recessed front for mounting a picture therein, said frame having a generally flat rear wall, fire resistant means associated with said rear wall, sealed storage compartment means arranged in said frame and extending at least part way therearound for storing a pressurized fire extinguishing medium therein, an access opening in said rear wall at one end thereof, valve controlled nozzle means associated with said storage compartment and projectable through said access opening, whereby said frame may be reversibly held by the user with said fire resistant wall means in front of a fire and extinguishing medium from said compartment directed through said nozzle thereat while the user is shielded and protected by said rear wall and fire resistant means.

2. In a device, according to claim 1, wherein said frame is generally rectangular.

3. In a device, according to claim 2, wherein said fire resistant means includes a flat panel associated with said rear wall.

4. In a device, according to claim 3, wherein said compartments respectively extend vertically at one end of said rear wall and panel means and transversely across the bottom of said frame.

5. In a device, according to claim 3, wherein said fire extinguishing valve nozzle means is housed within an end compartment, and an access opening is formed in an end wall of said end compartment for insertion of the user's hand therethrough and actuation of the nozzle valve control means.

6. In a device, according to claim 5, wherein said nozzle valve control means includes a pivoted control handle.

7. In a device, according to claim 6, wherein locking pin means is associated with and for locking said handle in inoperative position.

8. In a device according to claim 7, wherein said frame includes flat top, bottom, end and rear walls, and said front walls are angular inset and mitered to accommodate a picture therein.

* * * * *